US006350415B1

(12) United States Patent
Niermann et al.

(10) Patent No.: US 6,350,415 B1
(45) Date of Patent: Feb. 26, 2002

(54) BALL AND SOCKET CLOSURE FOR SPECIMEN COLLECTION CONTAINER INCORPORATING A DIMPLE LOCKING MECHANISM

(75) Inventors: Volker Niermann, Little Falls; Don Carano, Flanders; Steve Savitz, Teaneck; Katherine Birkland, Wayne; Robert Gottlieb, Mahwah, all of NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 08/928,058

(22) Filed: Sep. 12, 1997

(51) Int. Cl.[7] ..... B01L 3/14

(52) U.S. Cl. ..... 422/103; 422/99; 422/102; 222/507; 222/548

(58) Field of Search ..... 222/505, 507, 222/534, 535, 542, 545, 548, 556; 422/99, 102, 103

(56) References Cited

U.S. PATENT DOCUMENTS

| | | | | |
|---|---|---|---|---|
| 1,430,313 | A | 9/1922 | Millity | 215/313 |
| 1,691,811 | A | 11/1928 | Johnson | 222/507 |
| 1,726,642 | A | 9/1929 | Betts | 222/545 |
| 1,747,550 | A | 2/1930 | Klimburg | 222/507 |
| 1,882,180 | A | 10/1932 | Davidson et al. | 222/545 |
| 2,030,696 | A | 2/1936 | Forster | 222/542 |
| 2,032,776 | A | 3/1936 | Van Ness | 222/541.6 |
| 2,120,510 | A | 6/1938 | Rhoads | 222/507 |
| 2,126,814 | A | 8/1938 | Rest | 29/505 |
| 2,135,848 | A | 11/1938 | Sandstrom | 222/142.4 |
| 2,209,050 | A | 7/1940 | Church | 222/556 |
| 2,558,671 | A | 6/1951 | Cherry | 222/507 |
| 2,749,566 | A | 6/1956 | Thomas | 401/213 |
| 2,779,519 | A | 1/1957 | Rossetti | 222/507 |
| 2,805,801 | A | 9/1957 | Jacobs et al. | 222/545 |
| 2,885,128 | A | 5/1959 | Zimmerli | 222/507 |
| 2,990,980 | A | 7/1961 | Gronemeyer | 222/536 |
| 3,702,165 | A | 11/1972 | Carow et al. | 222/153.14 |
| 3,703,249 | A | 11/1972 | Middleton | 222/507 |
| 3,703,250 | A | 11/1972 | Middleton | 222/507 |
| 3,782,608 | A | 1/1974 | Schneider | 222/507 |
| 3,863,818 | A | 2/1975 | Hazard | |
| 4,181,246 | A | 1/1980 | Norris | 222/548 |
| 4,390,111 | A | 6/1983 | Robbins et al. | 220/259 |
| 4,515,752 | A | 5/1985 | Miramanda | 422/99 |
| 5,225,165 | A | 7/1993 | Perlman | 422/102 |
| 5,433,716 | A | 7/1995 | Leopardi et al. | 604/415 |

FOREIGN PATENT DOCUMENTS

| | | |
|---|---|---|
| EP | 0386 475 A1 | 12/1990 |
| EP | 0622 623 A2 | 2/1994 |
| GB | 448119 | 6/1936 |
| GB | 463118 | 3/1937 |
| GB | 479200 | 2/1938 |
| IT | 447478 | 4/1949 |
| IT | 539850 | 2/1956 |
| IT | 5696111 | 11/1957 |
| JP | 12-6531 | of 0000 |
| JP | 36-28284 | 10/1961 |
| JP | 50-3948 | 1/1975 |
| JP | 63-2162 | of 1988 |
| JP | 5-170256 | 7/1993 |
| WO | WO 96/15705 | 5/1996 |
| WO | WO 98/03410 | 1/1998 |

*Primary Examiner*—Jill Warden
*Assistant Examiner*—Dwayne K Handy
(74) *Attorney, Agent, or Firm*—Hoffmann & Baron, LLP

(57) ABSTRACT

A closure for sealing the open end of a specimen collection container from the environment is provided. The closure includes a socket mountable on the open end of the collection container for enclosing an interior region of the collection container. The socket includes a ball receiving internal surface having a protrusion thereon. The closure further includes a generally spherical-shaped ball mounted within the socket and at least partially enclosed by the socket. The ball is capable of rotative movement within the socket between an open position and a closed position. The ball includes an external surface capable of interference engagement with the protrusion of the socket upon rotative movement of the ball between the open position and the closed position.

8 Claims, 17 Drawing Sheets

BALL AND SOCKET CLOSURE FOR SPECIMEN COLLECTION CONTAINER INCORPORATING A DIMPLE LOCKING MECHANISM

FIELD OF THE INVENTION

The present invention is directed generally to a closure for a container. More specifically, the present invention relates to a ball and socket closure for use with specimen containers for biological and non-biological samples.

BACKGROUND OF THE INVENTION

Medical specimens, for example, biological and non-biological fluids, solids and semi-solids, are routinely collected and analyzed in clinical situations for various purposes. In particular, biological fluids such as blood, urine, and the like are typically collected in a specimen collection container which is in the shape of an open-ended tube. Such a tube is generally in the form of an elongate cylindrical member having one end open and an opposing end permanently closed by an integral semi-spherical portion, with the tube defining an interior which collects and holds the specimen.

After a biological sample has been drawn and/or collected in the tube, the tube with the sample is typically transported to a clinical testing laboratory for analysis. For example, blood samples may undergo routine chemistry, hormone, immunoassay or special chemical testing. In order to conduct such testing, the sample is normally transferred from the primary tube in which the sample was collected into one or more secondary tubes for testing and analysis, oftentimes to effect simultaneous testing in two or more different areas. In order to minimize contamination, evaporation and spilling during transportation, analysis and storage, it is important to maintain the open end of the tube with a closure.

The open end of a specimen container is typically sealed by a resilient cap, a removable rubber stopper, or plastic film during transport and analysis. Such closures provide means for sealing the open end of the tube, but are not capable of being efficiently removed, stored and replaced without causing contamination and with the use of one hand, as is often desired in clinical environments. Furthermore, when using analytical testing equipment for testing biological samples, it is typically necessary to maintain the samples in an open container to allow a probe from the testing equipment to be inserted into the container. In view of these needs, it is desirable to have a closure that can be easily and repeatedly opened and closed for manual or automated access.

One particularly useful type of closure for containers is a ball and socket type closure. While a number of ball and socket type closures for various containers are known, none are entirely effective for use in specimen collection containers, where an adequate seal is essential.

Further, it is often desirable to provide closures for containers with a locking mechanism. For example, U.S. Pat. No. 2,032,776 to Van Ness describes a closure for a dispensing container including a valve ball having a bore which sits within a curved boss on a resilient disc having an opening into the container. In one embodiment, the valve ball may include a projection of similar size to the opening of the resilient disc such that, when the ball is in the closed position, the projection sits within the opening of the resilient disc to lock the ball in place.

Still further, U.S. Pat. No. 4,181,246 to Norris discloses a closure for a collapsible tube which incorporates a stationary ball attached to the open end of the tube and including a bore therethrough and a moveable cap covering the stationary ball. The cap includes openings therein which can be aligned with the bore of the stationary ball upon movement of the cap. In one specific embodiment of this invention, the cap includes a detent which snaps into a recess in the ball for providing a locking mechanism for the closure.

Accordingly, it is desirable to provide a closure for a specimen collection container which can be easily and repeatedly opened and closed and which can effectively provide an adequate seal.

SUMMARY OF THE INVENTION

It is an object of the present invention to provide a closure for a specimen collection container which can be easily manufactured.

It is a further object of the present invention to provide a closure capable of being easily and repeatedly opened and closed.

It is yet a further object of the present invention to provide a closure for a specimen collection container which can be repeatedly opened and closed while maintaining an adequate seal.

In the efficient attainment of these and other objects, the present invention provides a closure for sealing the open end of a specimen collection container from the environment. The closure includes a socket mountable on the open end of the collection container for enclosing an interior region of the collection container. The socket includes a ball receiving internal surface having a protrusion thereon. The closure further includes a generally spherical-shaped ball mounted within the socket and at least partially enclosed by the socket. The ball is capable of rotative movement within the socket between an open position and a closed position. The ball includes an external surface capable of interference engagement with the protrusion of the socket upon rotative movement of the ball between the open position and the closed position.

The protrusion may include a rib along the ball receiving internal surface, or may include a dimple on the ball receiving internal surface.

Desirably, the ball includes an environment-contacting surface which is exposed to an external environment when the ball is in a closed position. The environment-contacting surface is preferably recessed with respect to the general spherical-shape of the ball to define a perimetrical edge therearound. Further, the socket preferably includes an open upper end permitting exposure of the environment-contacting surface to the external environment when the ball is in a closed position. More preferably, the protrusion is located on the ball receiving internal surface of socket at a position adjacent the open upper end of the socket. As such, the perimetrical edge of the ball and the protrusion of the socket are capable of interference engagement therebetween.

In a further embodiment of the present invention, a closure for sealing an open end of a specimen collection container from the environment is provided which includes a socket mountable on the open end of the collection container for enclosing an interior region of the collection container. The socket includes a ball receiving internal surface having a protrusion thereon. The closure further includes a generally spherical-shaped ball mounted within the socket which is capable of rotative movement between an open position and a closed position. The ball includes an environment-contacting surface, an opposed specimen-contacting surface and a passageway extending therethrough. The passageway is aligned with the open end of the collection container when the ball is in an open position, while the environment-contacting surface is exposed to an external environment and the specimen-contacting surface is exposed to the interior region of the collection container when the ball is in a closed position. The environment-contacting surface of the ball is recessed with respect to the general spherical-shape of the ball to define a perimetrical edge. As such, the environment-contacting surface does not contact the interior surface of the socket when the ball is in the open position, and rotative movement of the ball within the socket between an open position and a closed position causes interference engagement between the perimetrical edge of the environment-contacting surface and the protrusion of the internal surface of the socket.

DETAILED DESCRIPTION OF THE PREFERRED EMBODIMENTS

The present invention may be described as a ball and socket closure for use with specimen collection containers. For purposes of the present invention, the term specimen collection container is used to represent any type of container useful for collecting, transferring, analyzing or storing a biological or non-biological sample, for example primary and secondary specimen tubes for blood collection and analysis.

The present invention takes the form of a ball and socket closure for a collection container capable of providing an adequate seal, and which is capable of preventing or minimizing transfer of contaminants between the external environment and the internal contents of the container.

Figure 1:
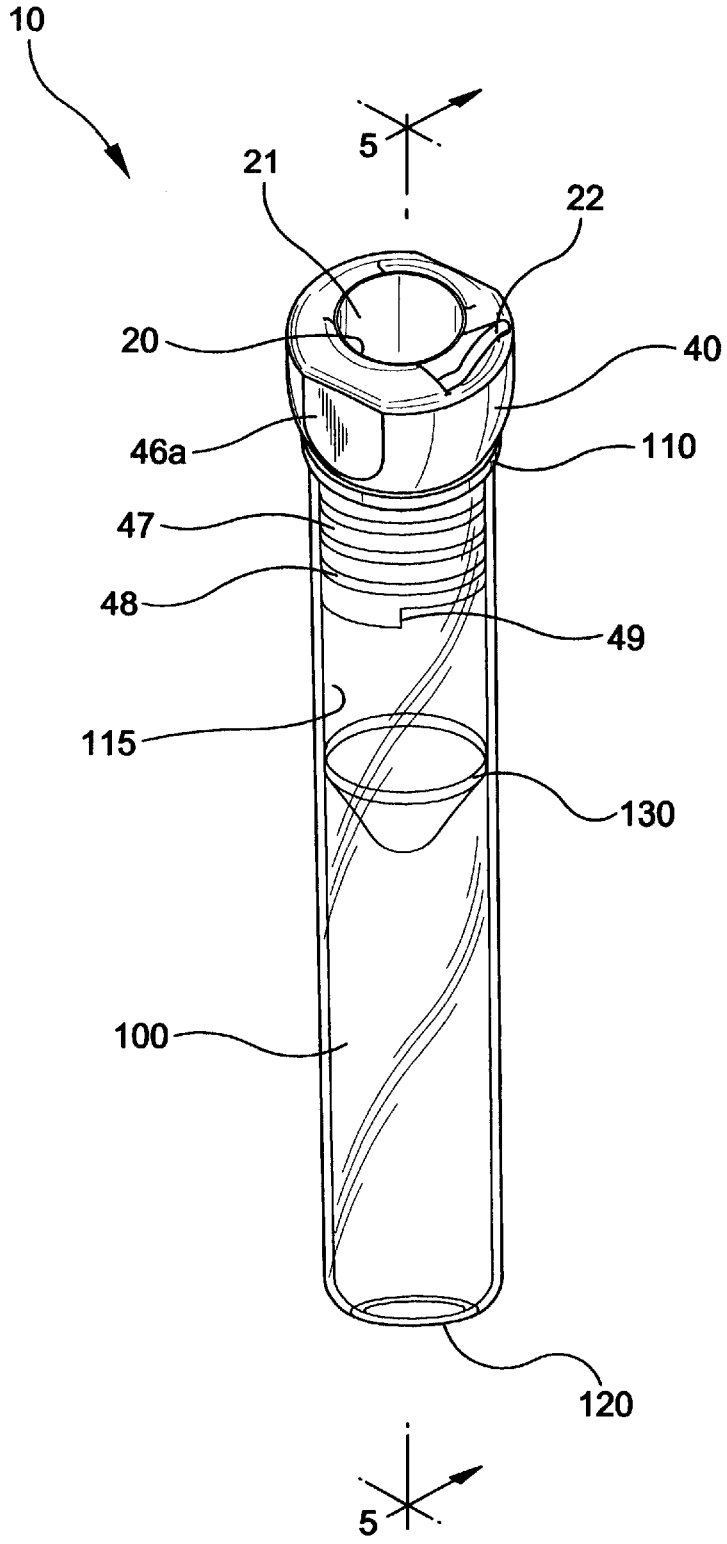
FIG. 1 represents a perspective view of a specimen collection assembly including the closure of the present invention depicted in its open state.
Figure 2:
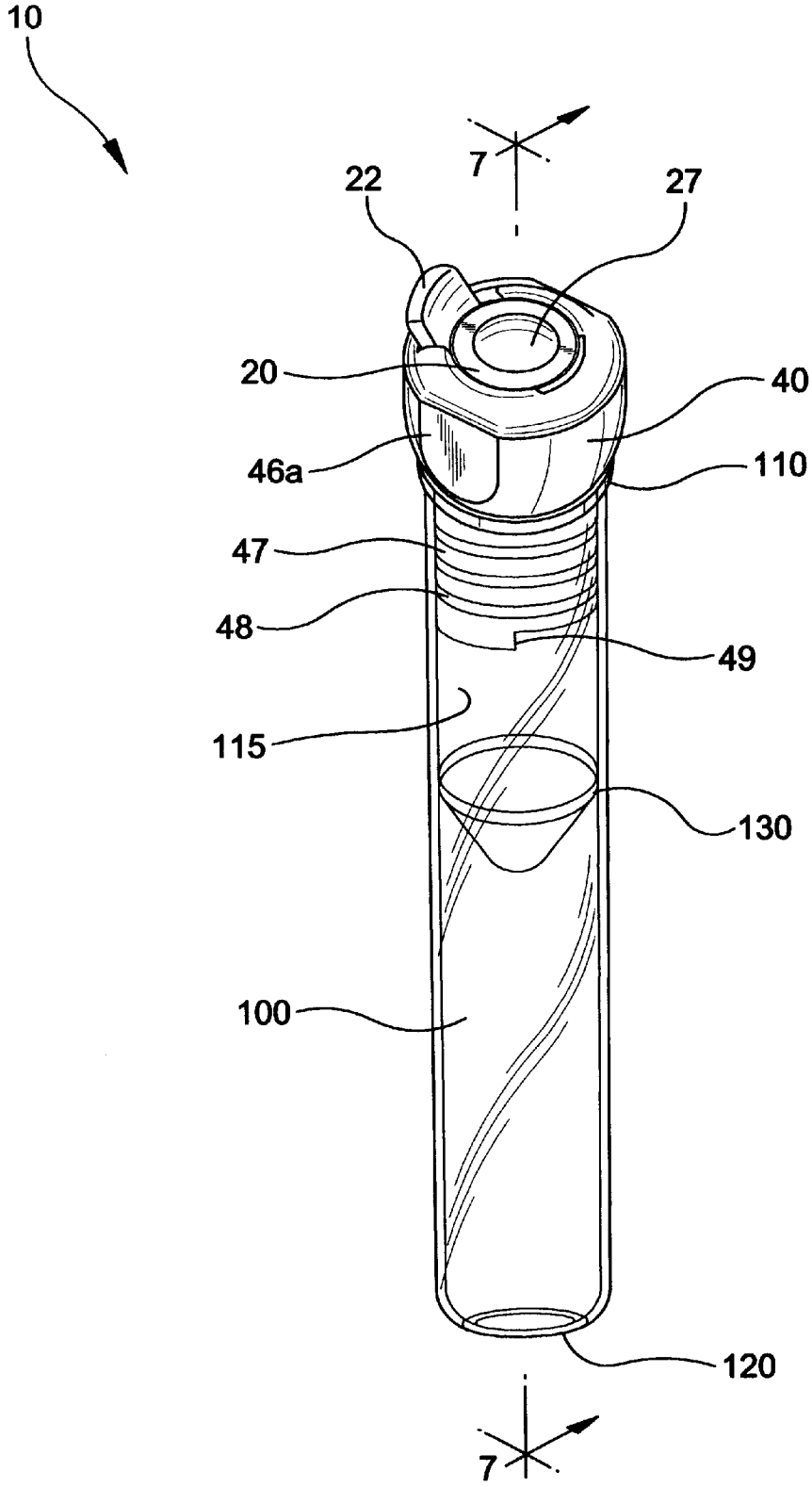
FIG. 2 represents a perspective view of a specimen collection assembly including the closure of the present invention depicted in its closed state.

With specific reference to the embodiment of FIGS. 1 and 2, a closure 10 is shown positioned over a blood collection tube 100, respectively, in an open and closed position. Closure 10 is adapted for interfitting engagement with collection tube 100 at open end 110 thereof. Collection tube 100 may be any type of collection tube known in the art, and may be constructed of any known material such as glass or, more preferably, a suitable plastic. Preferably, collection tube 100 is a false bottom tube including open end 110 at the top thereof and an opposed open bottom end 120, with a conical bottom 130 located between open end 110 and bottom end 120. Conical bottom 130 provides collection tube 100 with an upper chamber 115 for holding small volumes of liquid. Such a structure allows for easy access to liquid contained in upper chamber 115 when utilizing a manual transfer pipette or an automated sample probe from a clinical analyzer. By incorporating conical bottom 130, collection tube 100 can be used with standard holders and analyzer equipment without the need for such a pipette or probe to travel the full length of collection tube 100 to access the sample contained therein.

Figure 16:
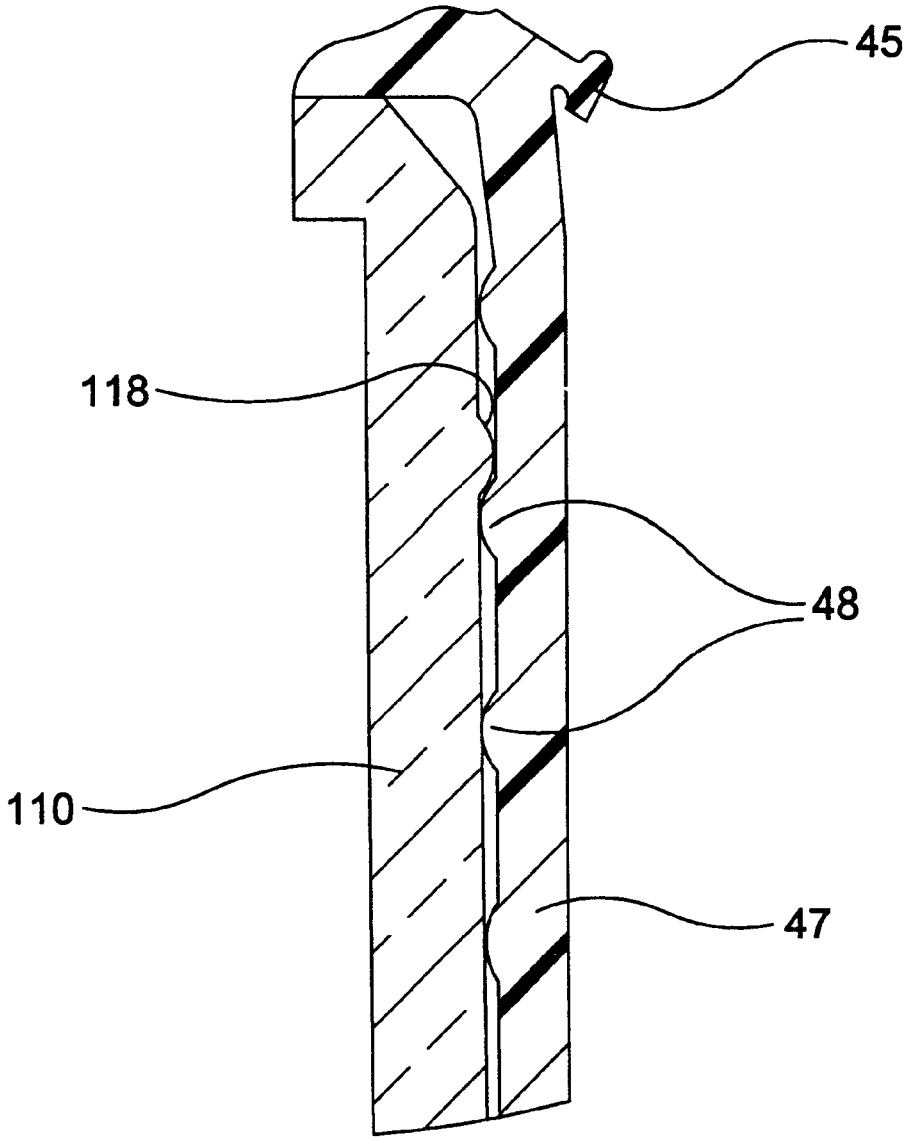
FIG. 16 represents an enlarged cross-sectional view of the closure of the present invention attached to a collection container.

Closure 10 includes a generally spherical-shaped socket 40 and a cylindrical protrusion 47 depending from a bottom end of socket 40. Cylindrical protrusion 47 is adapted for interfitting engagement within open end 110 of collection tube 100, thereby providing means for attaching closure 10 to collection tube 100. Cylindrical protrusion 47 may be adapted for interfitting engagement with collection tube 100 in any manner, for example by snap-fit, threaded engagement, and the like. Preferably, as best shown in FIG. 16, cylindrical protrusion 47 includes a plurality of annular ribs 48 spaced along an outer surface thereof, to provide for frictional engagement with the inside surface of collection tube 100 at open end 110. More preferably, annular ribs 48 provide for frictional engagement with an annular ring 118 provided on the inside surface of collection tube 100 at open end 110. As shown in FIG. 16, such interfitting of annular ribs 48 and annular ring 118 provide for multiple positions of frictional securement of closure 10 within collection tube 100, while providing a fluid-tight seal for preventing fluid contained within collection tube 100 from passing between cylindrical portion 47 and open end 110 of collection tube 100. In this manner, closure 10 may be firmly fitted and attached to collection tube 100 in a liquid-tight manner, and may be easily removed from collection tube 100 if desired.

As best shown in FIGS. 1 and 2, cylindrical protrusion 47 may further include one or more projections 49 for alignment and orientation of closure 10 during assembly, for example, in a feeder bowl.

Figure 3:
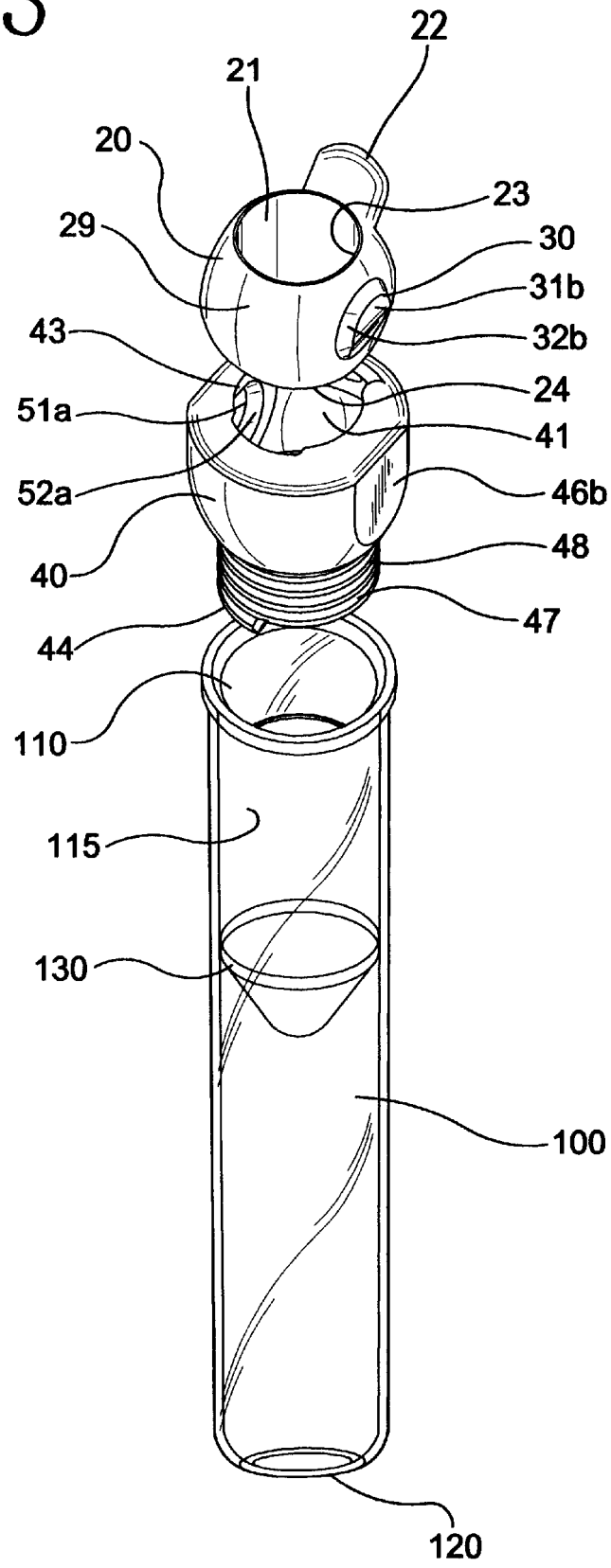
FIG. 3 represents a perspective view of the closure of the present invention shown unassembled.
Figure 4:
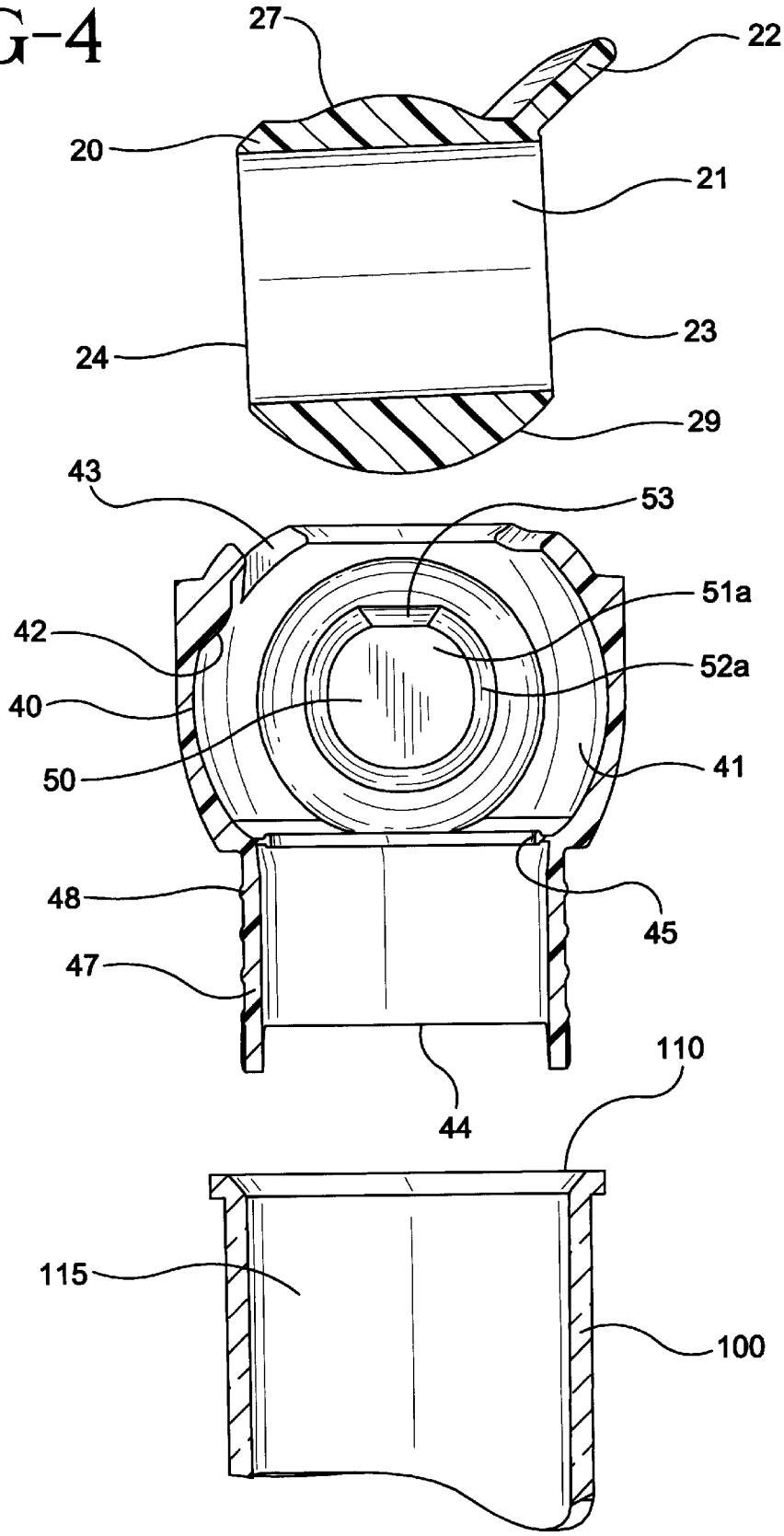
FIG. 4 represents an enlarged cross-sectional view of the closure of the present invention shown unassembled.

As shown in FIGS. 3 and 4, closure 10 further includes a generally spherically-shaped ball 20 fitted within socket 40. Ball 20 includes a passageway 21 extending therethrough. Preferably, passageway 21 is in the form of a cylindrical bore, which extends through ball 20 from a first open end 23 of ball 20 to an opposed second open end 24 of ball 20.

Passageway 21 provides an opening through ball 20 for permitting access between the outside environment and upper chamber 115 of collection tube 100, as will be discussed in more detail herein.

The internal diameter of passageway 21 should be large enough to allow access of a probe therethrough and to allow fluid flow therethrough. It is important, however, that the overall outside diameter of closure 10 must not be too large. For example, if the outside diameter of closure 10 or socket 40 is significantly larger than the outside diameter of a standard collection tube, collection tube 100 with closure 10 assembled thereon may not properly fit or function in conventional testing equipment. More particularly, closure 10 is particularly useful in testing environments where conventional covers would need to be removed from a collection container prior to testing of the sample. As such, collection tubes typically conform to a standard size to be useful with such equipment. As closure 10 of the present invention may be used during analysis without the need to remove the entire closure 10 from collection tube 100, closure 10 preferably is capable of fitting within the boundary of such standard size testing equipment without the need for removal thereof. Therefore, the outside diameter of closure 10 or socket 40 is preferably less than approximately 19.05 millimeters in order to properly function with standard equipment. With such an outside diameter, the internal diameter of passageway 21 is preferably approximately 10.5 millimeters. In alternate embodiments, closure 10 may be of a sufficient diameter such that, when coupled to collection tube 100, closure 10 is capable of supporting collection tube 100 in various testing equipment such as storage racks, carousels, etc.

Figure 6:
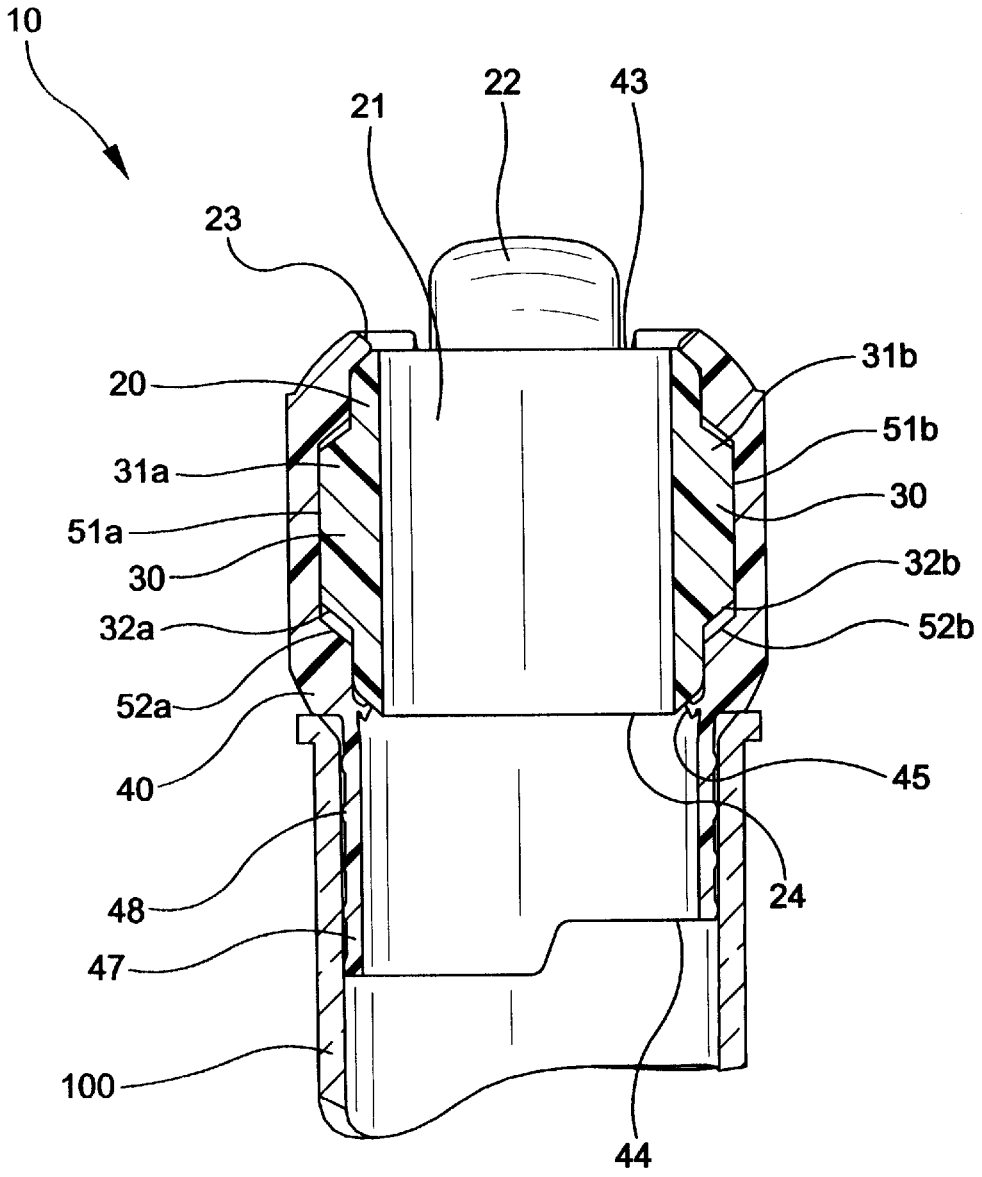
FIG. 6 represents a cross-sectional view of the closure of the present invention in an open state taken along lines 6—6 of FIG. 5.
Figure 8:
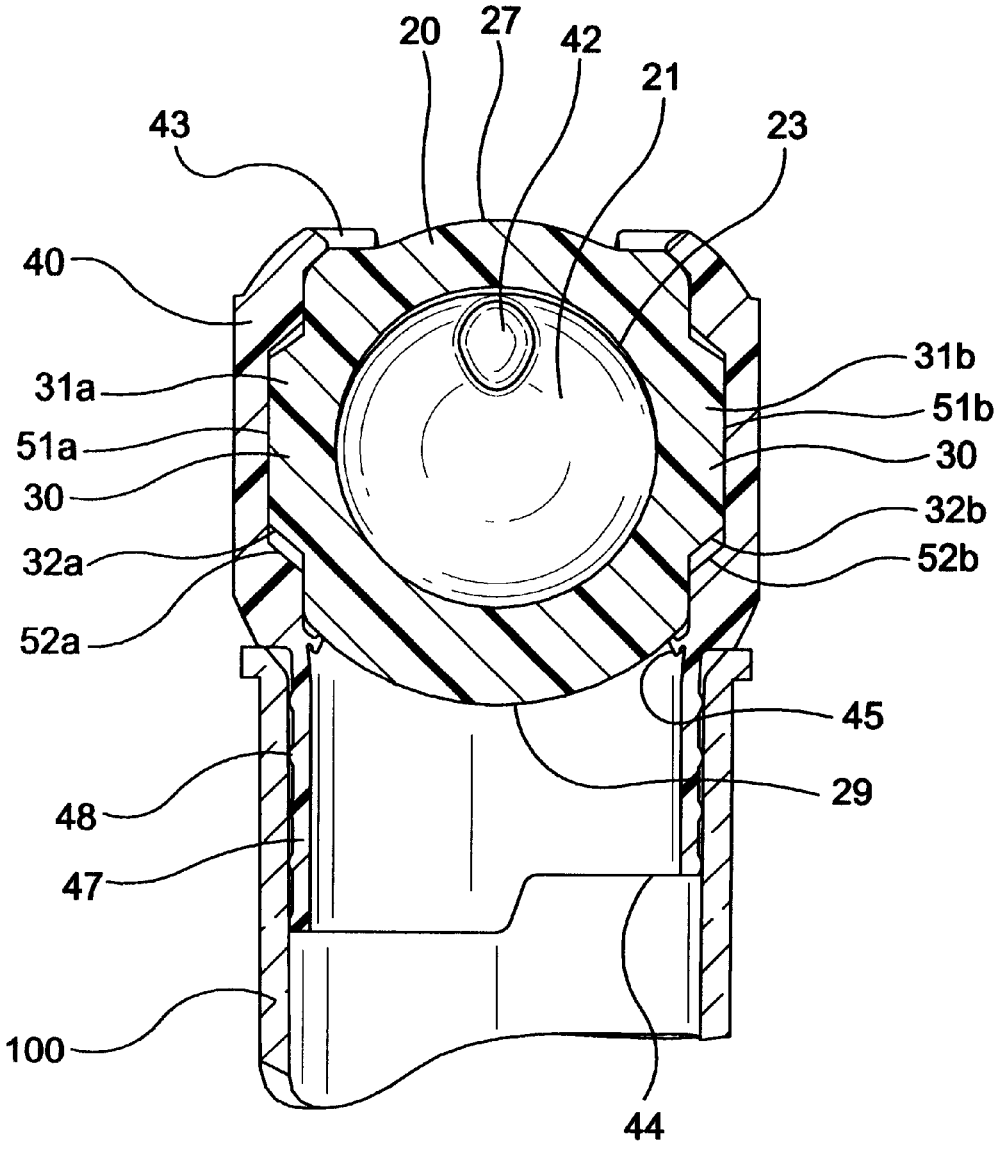
FIG. 8 represents a cross-sectional view of the closure of the present invention in a closed state taken along lines 8—8 of FIG. 7.

Ball 20 further includes an axle 30. Axle 30 permits rotative movement of ball 20 within socket 40 about an axis between an open position and a closed position, as will be discussed in more detail herein. Axle 30 is preferably defined by a pair of opposed protrusions 31*a* and 31*b* on opposed surfaces of ball 20, as best seen in FIGS. 6 and 8. Opposed protrusions 31*a* and 31*b* may be cylindrical-shaped protrusions, or alternatively, may include drafted surfaces 32*a* and 32*b*, to corresponded with tapered surfaces 52*a* and 52*b* of socket 40, as will be discussed in further detail herein. Alternatively, axle 30 may be defined by a pair of opposed cavities on opposed surfaces of ball 20, which opposed cavities engage with opposed protrusions within socket 40.

As noted above, ball 20 fits within socket 40 to form closure 10. Socket 40 includes a first open end 43 defining a perimetrical opening at the top thereof which is open to the external environment and a second open end 44 at the bottom end thereof which is open to the interior of collection tube 100. First open end 43 of socket 40 may include a contoured pouring surface for facilitating pouring of the contents of collection tube 100. Socket 40 may be of a generally spherical external shape. Alternatively, socket 40 may include opposed planar sides 46*a* and 46*b* on the external surface thereof. Such opposed planar sides 46*a* and 46*b* permit ease in manufacturing of closure 10, and provide a means for alignment of closure 10 with a specific reference point during assembly or for alignment with a plurality of closures 10 during use in equipment such as storage racks, carousels, etc.

Figure 9:
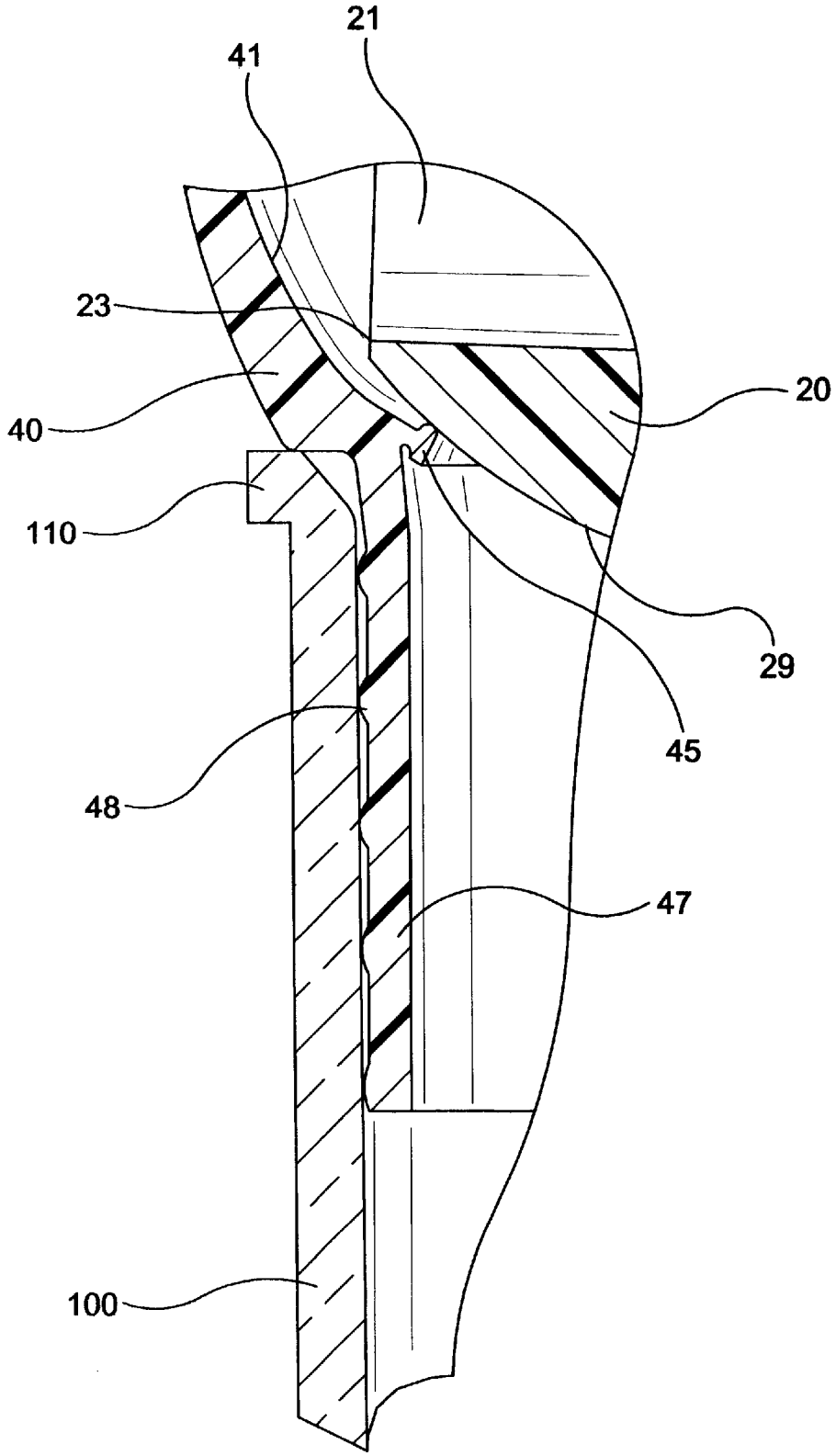
FIG. 9 represents an enlarged cross-sectional view showing a portion of the closure of the present invention in detail.

Socket 40 further includes a ball-receiving internal surface 41, for interfitting engagement with the outside surface of ball 20. Ball 20 fits within socket 40 in a contacting relation between the external surface of ball 20 and the perimeter of first open end 43 of socket 40, so as to establish engagement between ball 20 and socket 40 at first open end 43. Further, as shown in detail in FIG. 9, socket 40 further includes an annular ball seat 45. Ball seat 45 may be a separate component, or may be integral with socket 40 located at the lower portion of internal surface 41, thereby providing a seat for ball 20 when closure 10 is assembled. Ball seat 45 may be compressible and/or flexible, and is preferably constructed of an elastomeric material. Ball seat 45 provides for a seal between ball 20 and socket 40, as will be discussed herein. In order to provide additional sealing between ball 20 and socket 40, additional seals may be incorporated into closure 10.

Figure 15:
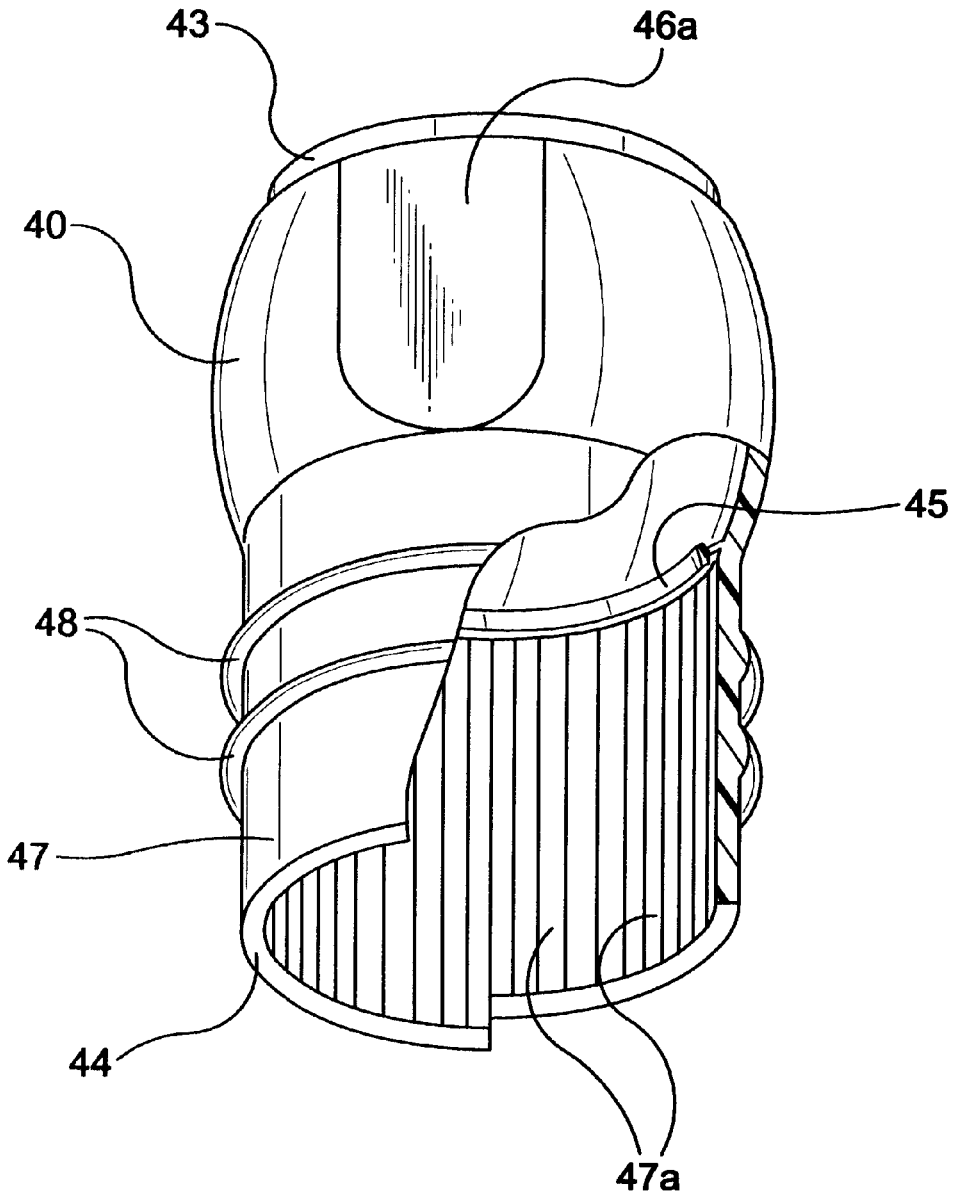
FIG. 15 represents a perspective view of a further embodiment of the closure of the present invention, showing a cut-out portion of cylindrical protrusion 47.

In an alternate embodiment of the present invention, cylindrical protrusion 47 may include vertical drainage channels 47*a* on an inside surface thereof, as shown in FIG. 15. Channels 47*a* direct fluid such as blood which remains on the inside wall of cylindrical protrusion 47 toward open end 48 of socket 40 and closure 10, as will be discussed in more detail herein.

As indicated, ball 20 is interfitted within socket 40 for rotative movement therein. Internal surface 41 is a generally spherical-shaped hollow opening which accommodates the shape of ball 20. Internal surface 41 includes axle-support 50 for receiving axle 30 of ball 20. Axle-support 50 may comprised of recessed cavities 51*a* and 51*b* at diametrically opposed sides thereof. Such opposed cavities 51*a* and 51*b* provide for intermitting engagement with opposed protrusions 31*a* and 31*b* of ball 20. Further, opposed cavities 51*a* and 51*b* may include tapered surfaces 52*a* and 52*b*, respectively, therein for engagement with drafted surfaces 32*a* and 32*b* of ball 20. Such tapered surfaces 52*a* and 52*b* and drafted surfaces 32*a* and 32*b* are not necessary, but are particularly useful for simplifying injection molding techniques for manufacture of closure 10. With ball 20 fitted within socket 40 as described, axle 30 provides for rotative movement of ball 20 thereabout within socket 40. In an alternate embodiment where ball 20 includes opposed cavities acting as axle 30 as noted above, axle support 50 may include opposed protrusions for interfitting engagement with such opposed cavities of ball 20.

Opposed cavities 51*a* and 51*b* of socket 40 may further include a flat edge 53 on a wall surface of one or both thereof. Flat edge 53 frictionally engages opposed protrusions 31*a* and 31*b* of ball 20 during rotative movement of ball 20 within socket 40. Flat edge 53 is capable of providing the operator with a positive feedback for establishing that ball 20 has been fully rotated to the open or closed position within socket 40, as will be discussed in more detail herein.

Figure 12:
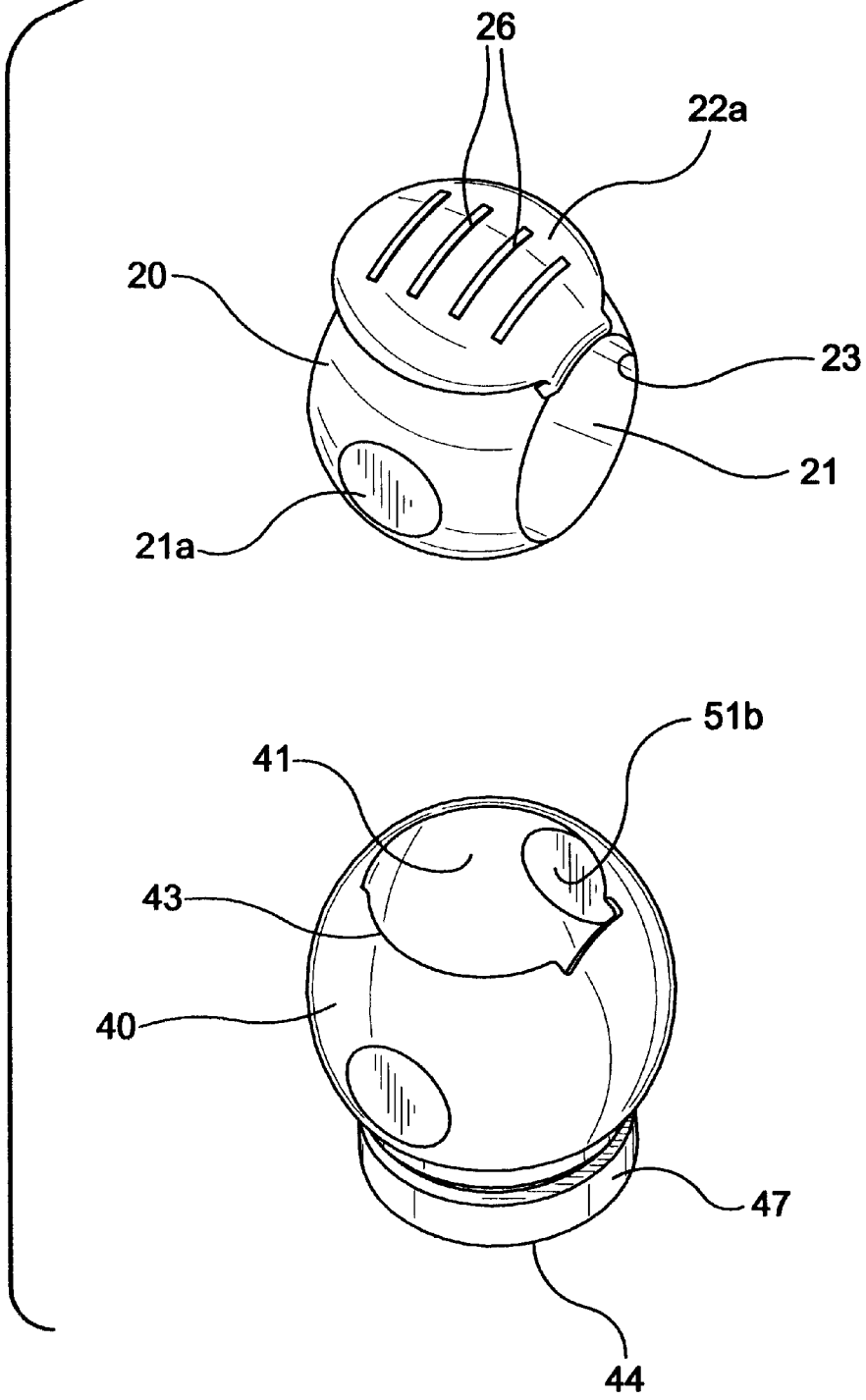
FIG. 12 represents a perspective view of an alternate embodiment of the closure of the present invention shown unassembled in a closed state.
Figure 13:
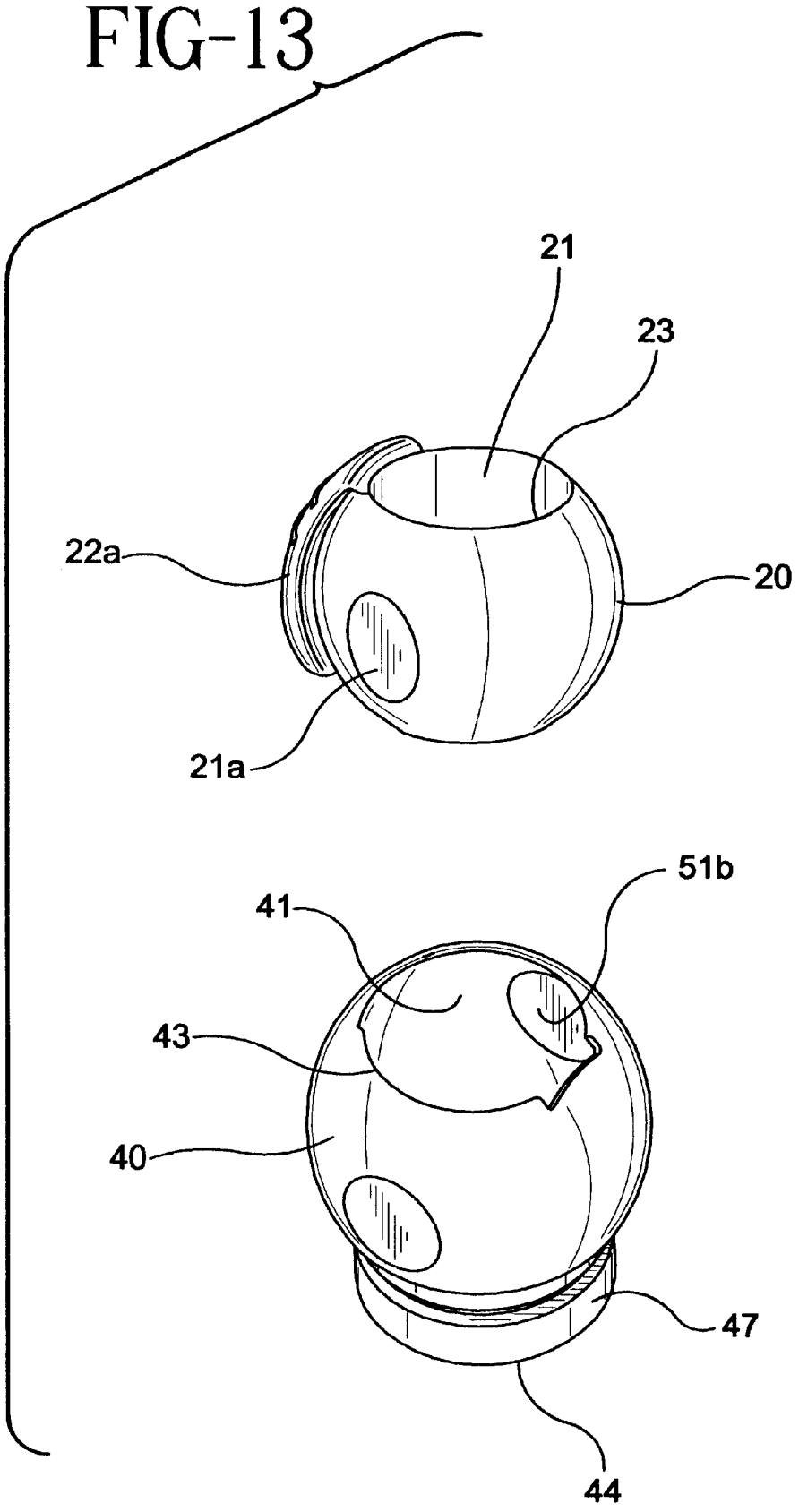
FIG. 13 represents a perspective view of the alternate embodiment depicted in FIG. 12 shown unassembled in an open state.

Rotative movement of ball 20 about axle 30 can be effected manually by providing ball 20 with externally accessible means for rotation such as tab 22 extending from the surface of ball 22. Tab 22 provides a protrusion for effecting movement of ball 20 within socket 40 by an operator's finger or thumb. Tab 22 may include a contoured pouring surface on a surface thereof for facilitating pouring of the contents of collection tube 100. In an alternate embodiment of the present invention, means for rotation of ball 20 within socket 40 can be in the form of a flap 22*a*, as depicted in FIGS. 12 and 13. Flap 22*a* may include ridges 26 therealong, which provide for frictional gripping of flap 22*a* by an operator's thumb of finger. During rotative movement of ball 20 within socket 40 between an open and closed position, flap 22*a* overrides an external surface portion of socket 40.

Rotation of ball 20 about axle 30 results in the alignment of first open end 23 of ball 20 with first open end 43 of socket 40 as well as alignment of second open end 24 of ball 20 with second open end 44 of socket 40. As such, a path is established by way of passageway 21 extending through ball 20 between the outside environment and upper chamber 115 of collection tube 100. Thus, rotation of ball 20 about axle 30 accomplishes movement of ball 20 between an open position when passageway 21 is in alignment with the interior of collection tube 100 through the alignment of first open ends 23 and 43 and second open ends 23 and 44 (shown in FIGS. 1, 5 and 6), and a closed position when passageway 21 is out of alignment with the interior of collection tube 100 due to first open ends 23 and 43 and second open ends 23 and 44 being out of alignment with each other (shown in FIGS. 2, 7 and 8).

Ball 20 is constructed and positioned within socket 40 so as to define an environment-contacting surface 27 and an opposed liquid-contacting surface 29. When closure 10 is in a closed position, environment-contacting surface 27 is exposed to the external environment while liquid-contacting surface 29 is exposed to the interior of collection tube 100, i.e. upper chamber 115. When closure 10 is in an open position, environment-contacting surface 27 and liquid-contacting surface 29 are positioned within the spherical-shaped hollow opening of socket 40 which forms internal surface 41. In preferred embodiments, environment-contacting surface 27 includes means for identifying when ball 20 is in a closed position. Such identifying means may include indicia diseinguishing between an open position and a closed position. For example, environment-contacting surface 27 may include a marking or wording thereon, or may include color coding signifying that the ball is in the closed position.

Figure 17:
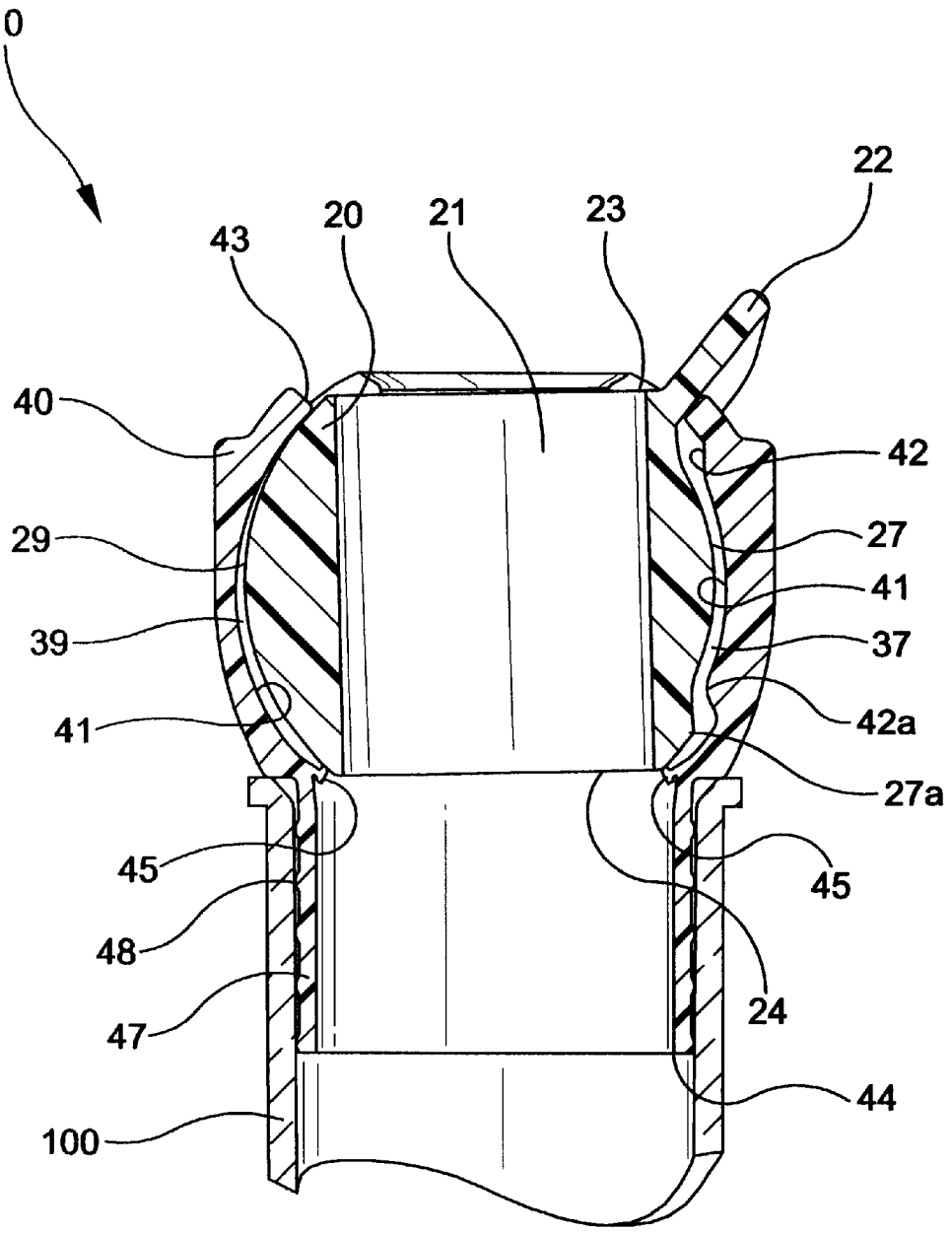
FIG. 17 represents a cross-sectional view of an alternate embodiment of the closure of the present invention in an open state.

Alternately, such means for identifying when ball 20 is in a closed position includes the incorporation of a stop-indicating element on internal surface 41 of socket 40 for engagement with environrment-contacting surface 27 when ball 20 is rotated to the closed position. For example, internal surface 41 of socket 40 may include a protrusion for example, in the form of dimple 42 at a location adjacent first open end 43 of socket 40. Dimple 42 may include a small protrusion extending from the internal surface 41 of socket 40. As will be discussed in more detail herein, dimple 42 provides an audible and tactile "click stop" feedback to the operator when environment-contacting surface 27 of ball 20 passes thereover, indicated that ball 20 has been fully rotated to the closed position. Alternatively, dimple 42 may include a protrusion in the form of a rib 42*a* extending along a length of internal surface 41 of socket 40, as shown in FIG. 17. Such rib 42*a* provides an operator with an audible and tactile "click-stop" feedback to indicate that ball 20 has been fully rotated to both the open and closed positions, as will be discussed.

While the use of locking mechanisms are known in the art, none are entirely effective for ball and socket closures wherein a ball is rotatably mounted within a socket, as in the present invention. For example, as discussed in the background, U.S. Pat. No. 4,181,246 discloses a closure wherein a cap is moveable over a stationary ball, with the cap including a detent which snaps into a recess in the ball to provide a locking mechanism. Since the ball is stationary as opposed to being moveable within the socket, however, the ball is always aligned with the opening of the container. On the other hand, in ball and socket closures where the ball is rotatable within a socket between an open position with a passage in alignment with a container and a closed position with a passage out of alignment with the container, it is often difficult to determine when the ball is fully rotated within the socket, due to the socket covering a large part of the ball. Accordingly, it is particularly useful to provide such a closure with an interference engagement between the socket and the rotatable ball to acknowledge when the ball has been fully rotated within the socket to a certain position.

Further, U.S. Pat. No. 2,032,776, discussed in the background, discloses a closure with a rotatable valve ball sitting within a boss which has a locking mechanism incorporating a projection on the ball. Such a closure is not effective for a ball and socket closure as in the present invention where socket 40 encompasses ball 20 in a tight manner about substantially the entire outer surface of ball 20. For example, by providing a projection on the ball as disclosed in U.S. Pat. No. 2,032,776, the outer surface of the ball would not rotate freely and easily within the surface of socket 40, as the projection would interfere with the proper interfitting of the ball within the socket. Furthermore, by providing a projection on the ball as disclosed in U.S. Pat. No. 2,032,776, the outer surface of the ball at the projection would necessarily contact the inner surface of the socket, which is undesirable in many applications, particularly when biological samples are involved.

As indicated above, axle 30 of ball 20 is defined by opposed protrusions 31*a* and 31*b*, and axle-support 50 of socket 40 is defined by opposed cavities 51*a* and 51*b*. When closure 10 is assembled, axle 30 is received in axle-support 50, i.e., opposed protrusions 31*a* and 31*b* are supported within opposed cavities 51*a* and 51*b*. In order to effect non-symmetric rotation of ball 20 within socket 40, axle 30 and axle-support 50 are parallel and eccentric with respect to each other.

Figure 10:
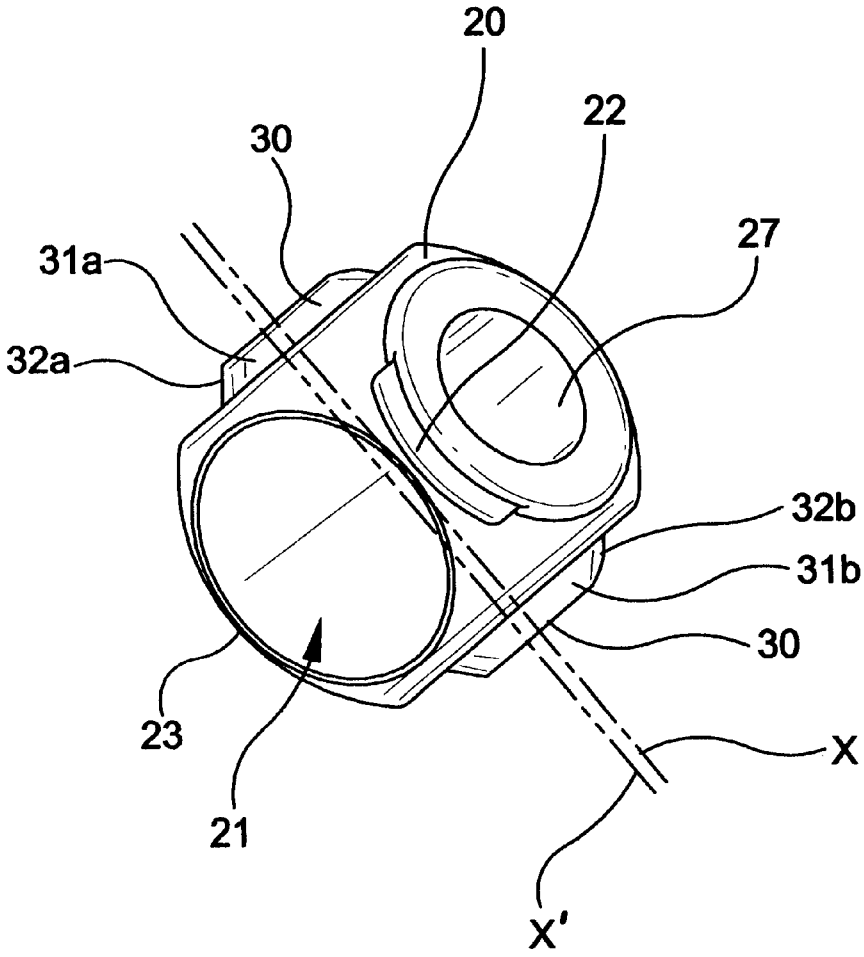
FIG. 10 represents a perspective view of the ball of the present invention, depicting the eccentric axle.

In a preferred embodiment of the present invention, the eccentric nature of axle 30 and axle-support 50 is preferably effected by off-setting axle 30 with respect to the true axis of ball 20. As shown in FIG. 10, a true axis X represents the actual common central axis of closure 10, defined by the sphere of ball 20 and the spherical-shaped hollow opening defined by internal surface 41 of socket 40. True axis X is generally perpendicular and transverse to passageway 21 of ball 20. In such a preferred embodiment, axle-support 50, defined by opposed cavities 51 and 51*b* of socket 40, is in alignment with true axis X. Axle 30, defined by opposed protrusions 31*a* and 31*b* of ball 20, may lie along a given eccentric axis X', which is also generally perpendicular and transverse to passageway 21, but positioned to be eccentric or off-set from true axis X. In other words, opposed protrusions 31*a* and 31*b* are not directly aligned along the true axis X of ball 20, but are slightly offset therefrom, thus making axle 30 slightly eccentric to true axis X. Alignment of axle 30 with axle-support 50 by way of opposed protrusions 31*a* and 31*b* of ball 20 fitting within opposed cavities 51*a* and 51*b* of socket 40 aligns ball 20 within socket 40, with ball 20 being slightly offset from interior cavity 41 of socket 40. The eccentric nature of axle 30 provides for non-symmetric rotation of ball 20 within socket 40 between the open and closed positions. In essence, rotation of ball 20 about axle 30 results in a cam-like engagement of opposed protrusions 31*a* and 31*b* with opposed cavities 51*a* and 51*b*, due to the alignment of axle 30 with eccentric axis X'. Such eccentric positioning of axle 30 urges ball 20 into seated positioning with ball seat 45 so as to provide a liquid-tight seal at ball seat 45, particularly when ball 20 is in a closed position, and further assists in preventing transfer of contaminants between the external environment and the interior of collection tube 100, as will be discussed in more detail herein.

Figure 11:
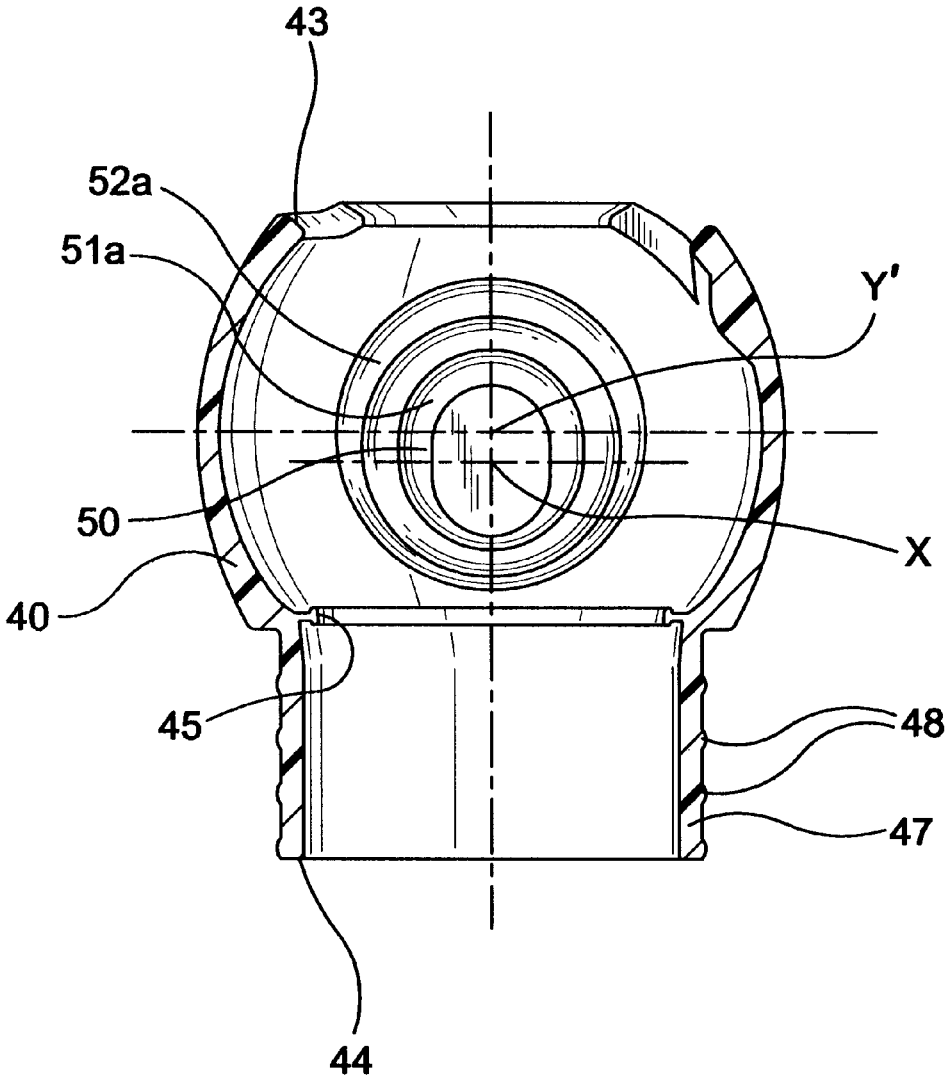
FIG. 11 represents a cross-sectional view of a socket in an alternate embodiment of the present invention.

In an alternate embodiment of the present invention, the eccentric nature of axle 30 and axle-support 50 can be effected by off-setting axle-support 50 with respect to true axis X. As shown in FIG. 11, axle-support 50, defined by opposed cavities 51*a* and 51*b* of socket 40, may lie along a given eccentric axis Y', which is also generally perpendicular and transverse to passageway 21 of ball 20, but positioned to be eccentric or off-set from true axis X. In other words, opposed cavities 51*a* and 51*b* are not directly aligned along the true axis X, but are slightly offset therefrom, thus making axle-support 50 slightly eccentric to true axis X. In such an embodiment, axle 30 may be aligned with true axis X, since the eccentric nature of axle-support 50 provides for non-symmetric rotation of ball 20 within socket 40 between the open and closed positions, in a similar manner as in the preferred embodiment.

It is also contemplated by the present invention that both axle 30 and axle-support 50 may be offset from or eccentric to true axis X. In such an embodiment, however, axle 30 and axle-support 50 must not be in alignment with each other but instead must remain eccentric with respect to each other in order to provide for non-symmetric rotation of ball 20 within socket 40 between the open and closed positions.

Figure 5:
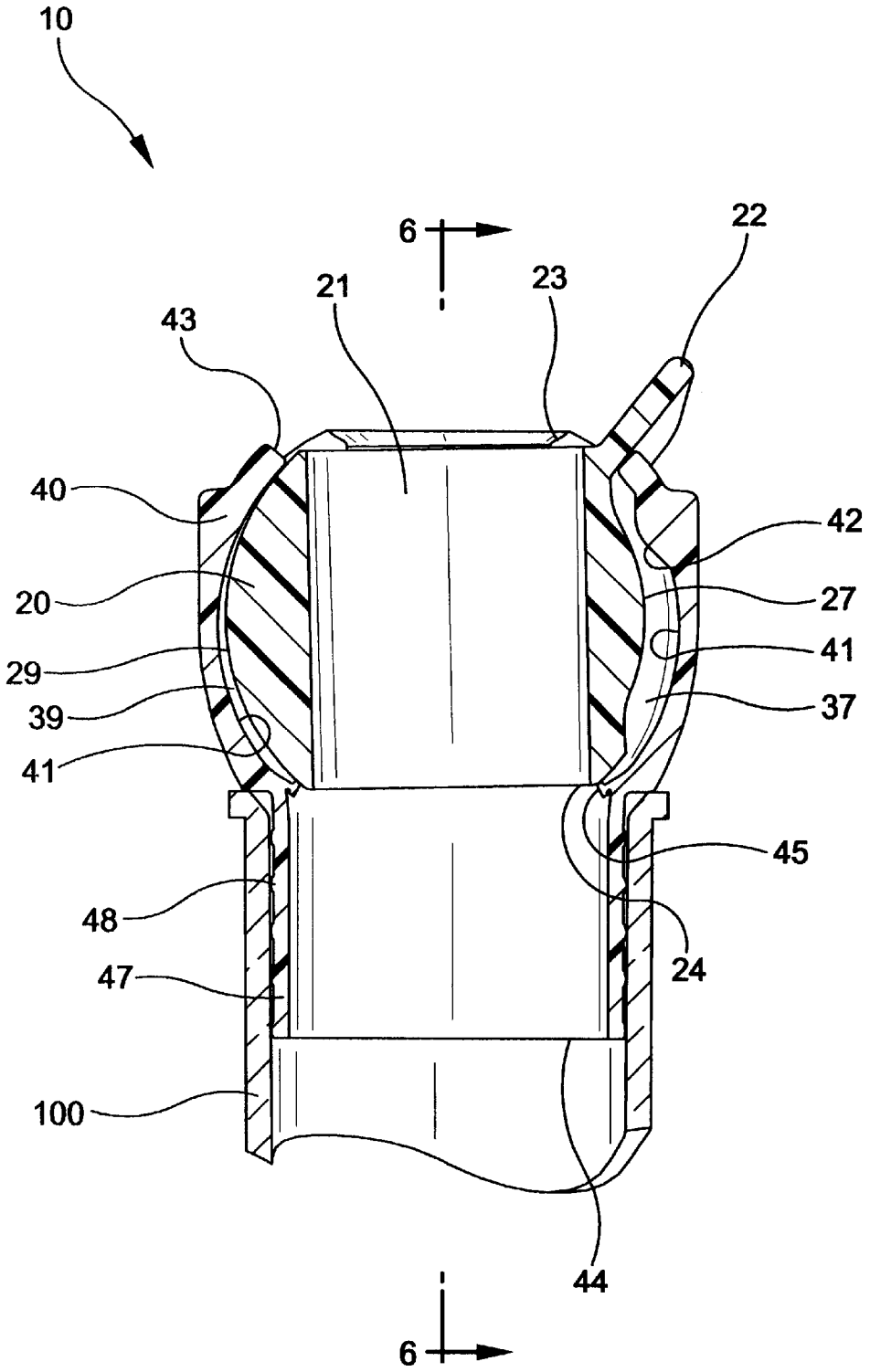
FIG. 5 represents a cross-sectional view of the closure of the present invention in an open state taken along lines 5—5 of FIG. 1.
Figure 7:
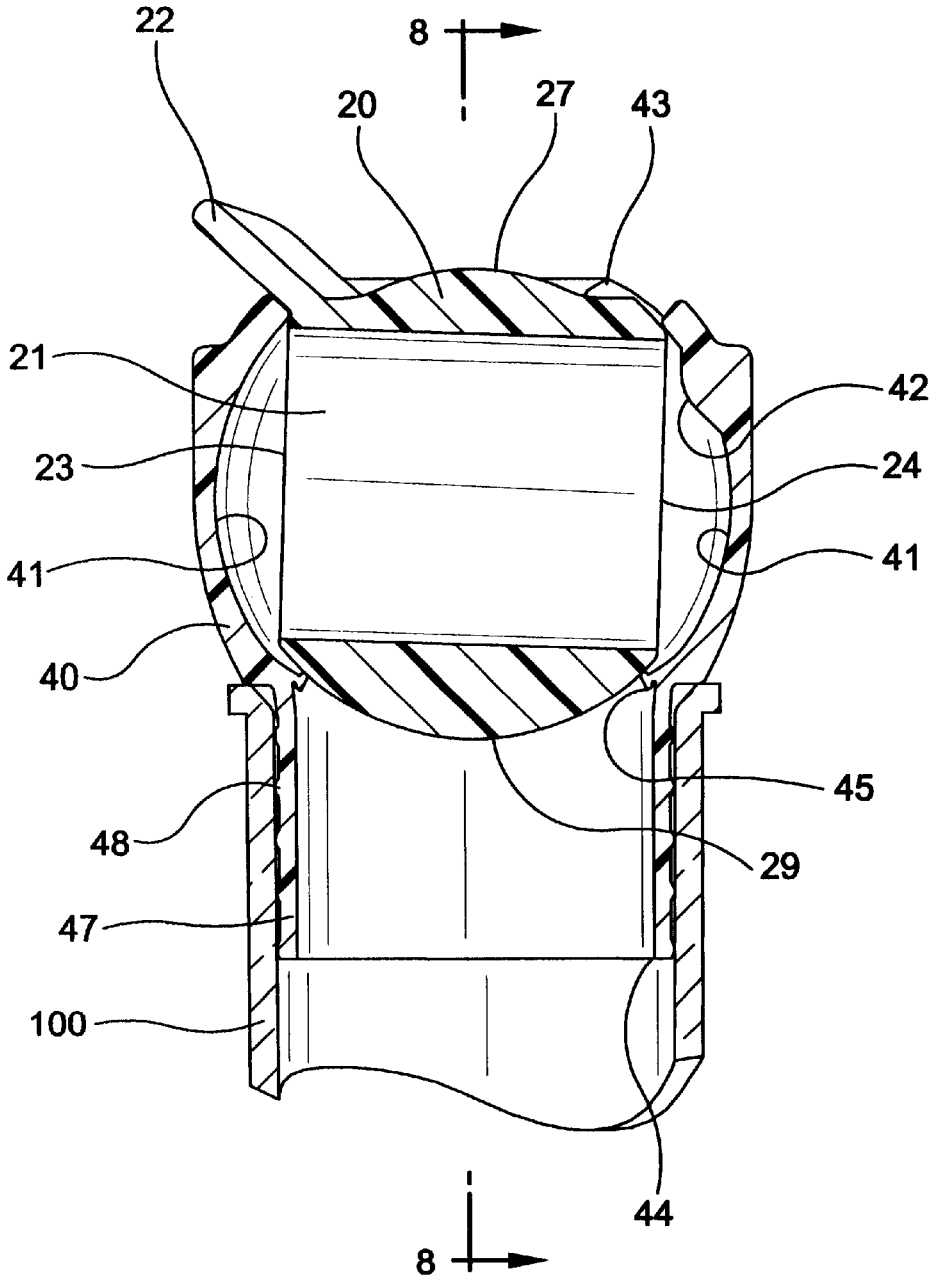
FIG. 7 represents a cross-sectional view of the closure of the present invention in a closed state taken along lines 7—7 of FIG. 2.

FIGS. 5 and 6 show cross-sectional front and side views of the closure 10 of the present invention in an open position, and FIGS. 7 and 8 show cross-sectional front and side views in a closed position. As seen in FIG. 6, since axle 30 and axle-support 50 are eccentric with respect to each other, ball 20 is positioned within socket 40 in a slightly offset manner when closure 10 is in the open position due to opposed protrusions 31*a* and 31*b* of ball 20 being aligned within opposed cavities 51*a* and 51*b* in socket 40 in an offset position. While ball 20 is seated on ball seat 45 of socket 40 in a liquid-tight sealing manner in this open position, minimal force is being placed on ball 20 in the longitudinal direction. This provides for ease of rotational movement of ball 20 about axle 30, while maintaining a liquid-tight seal to prevent blood or other fluid contained within collection tube 100 from traveling past ball seat 45.

Further, as noted above, when closure 10 is in an open position, environment-contacting surface 27 and liquid-contacting surface 29 are positioned within the sphere-shaped hollow opening of socket 40 which forms internal surface 41. As shown in FIG. 5, the offset positioning of ball 20 within socket 40 results in a gap or annular space 39 between liquid-contacting surface 29 of ball 20 and internal surface 41 of socket 40 when closure 10 is in an open position. Such an annular space 39 provides for ease of rotational movement of ball 20 within socket 40, and prevents contamination of any blood or other specimen from being transferred by contact between liquid-contacting surface 39 and interior surface 41. Furthermore, environment-contacting surface 27 is preferably recessed from the general spherical shape of ball 20 to define a perimetrical edge 27*a*, such that when closure 10 is in an open position, annular space 37 is provided between environment-contacting surface 27 and internal surface 41 of socket 40, thus maintaining a non-contacting relation therebetween. This non-contacting relation prevents contamination between environment-contacting surface 27 and interior surface 41.

It should be noted that, in embodiments of the invention wherein closure 10 incorporates a locking mechanism for interference engagement between ball 20 and socket 40 such as dimple 42 and rib 42*a* as discussed above, closure 10 may be adapted for symmetric rotation of ball 20 within socket 40 about axle 30, or may be adapted for non-symmetric rotation of ball 20 within socket 40 about axle 30.

Figure 14:
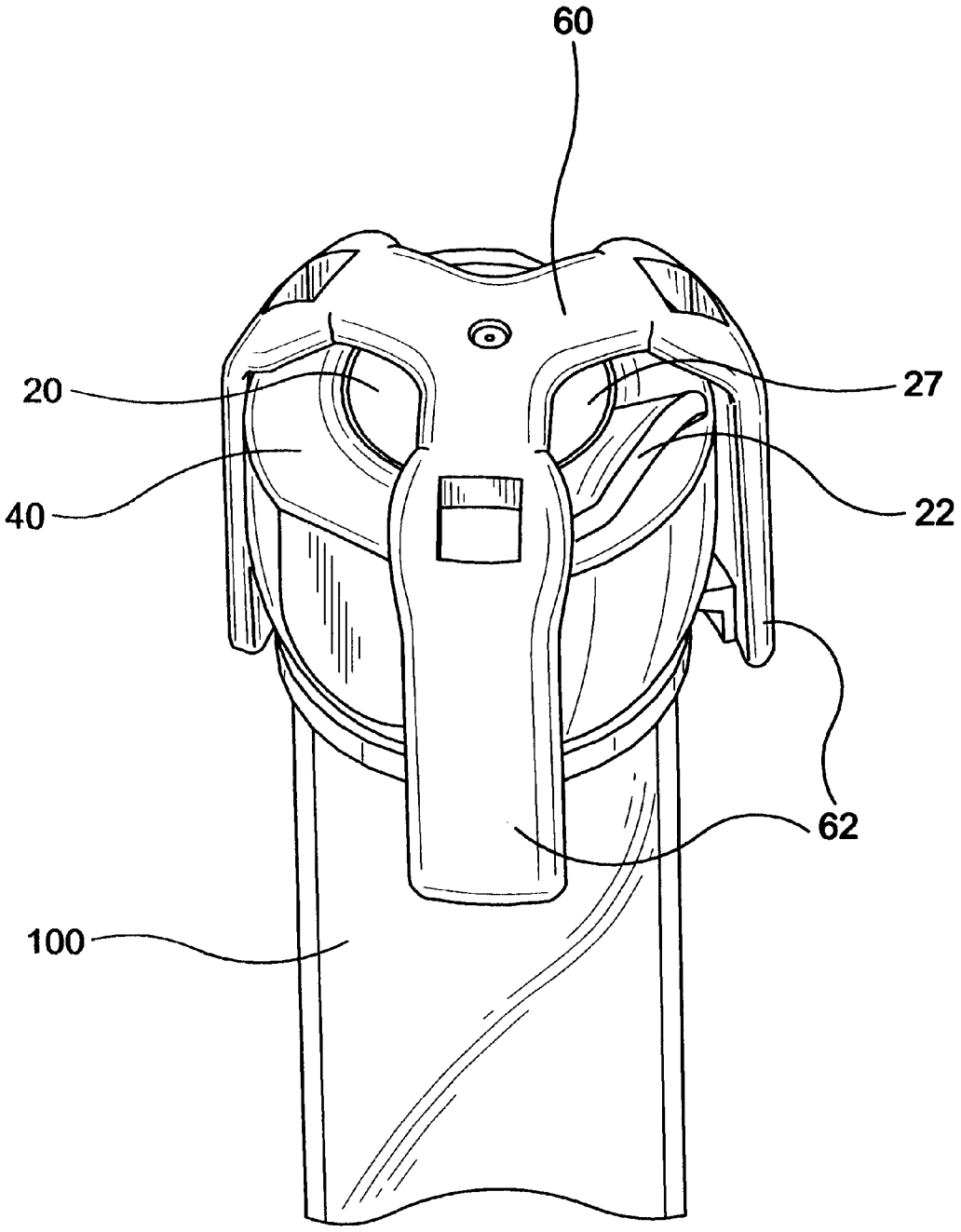
FIG. 14 represents a perspective view of a further embodiment of the closure of the present invention.

In a further embodiment of the present invention, closure 10 may include a separate locking mechanism for preventing rotational movement of ball 20 within socket 40, for example a clip, strap, band, or the like, for securing ball 20 in a closed position during transport or storage, or in an open position during use. Such a locking mechanism is preferably in the form of a clip 60, as shown in FIG. 14. Clip 60 includes three arms 62 equally spaced from each other. Arms 62 overlap closure 10, with tab 22 of ball 20 interfitting within the space between two adjacent arms 62. Such clip 60 provides an effective yet simple mechanism for locking closure 10 in position.

In use, closure 10 including ball 20 fitted within socket 40 is provided for engagement at open end 110 of collection tube 100. Clip 60 is removed from closure 10 to permit rotational movement of ball 20 within socket 40. Rotational movement of ball 20 within socket 40 about axle 30 accomplishes opening and closing of closure 10. For example, when closure 10 is in the closed position as shown in FIGS. 2, 7 and 8, environment-contacting surface 27 is positioned within first open end 43 of socket 40 and is exposed to the external environment while liquid-contacting surface 29 of ball 20 is positioned for exposure to upper chamber 115 of collection tube 100. The external surface of ball 20 contacts ball seat 45 in a sealing engagement, thus preventing any fluid contained within collection tube 100 from passing beyond ball seat 45 and between ball 20 and socket 40. An operator's finger engages tab 22 of ball 20, and applies pressure to tab 22 in a direction toward environment-contacting surface 27. Such pressure transmits a force to ball 20 about axle 30, thus causing ball 20 to rotate about axle 30 within socket 40. This rotative movement causes liquid-contacting surface 29 to engage ball seat 45, and the continuous rotative movement of ball 20 provides for a wiping action between ball seat 45 and liquid-contacting surface 29. Accordingly, any blood or other contaminant which is present on liquid-contacting surface 29 is wiped from the surface thereof by ball seat 45. Further, channels 47*a* in the inside surface of cylindrical protrusion 47 direct such blood or other contaminant from ball seat 45 toward open end 44 and back into upper chamber 115.

Full rotation of ball 20 within socket 40 is accomplished by moving tab 22 completely across first open end 43 of socket 40, with tab 22 resting on the perimeter of first open end 43. During this rotation, opposed protrusions 31*a* and 31*b* of ball 20 engage opposed cavities 51*a* and 51*b* of socket 40 in a cam-like fashion due to the eccentric nature of axle 30, thus slightly lifting ball 20 longitudinally within socket 40. This longitudinal lifting causes ball 20 to be slightly lifted from ball seat 45. As ball seat 45 is flexible, ball seat 45 flexes with the longitudinal movement of ball 20, thereby maintaining a contacting relation between ball seat 45 and ball 20 to maintain a liquid-tight seal. Upon full rotation of ball 20 within socket 40, the eccentric nature of axle 30 causes liquid-contacting surface 29 to be rotated to a position within socket 40 in a non-contacting relation with internal surface 41 of socket 40, separated therefrom by annular space 39. In a similar manner, the recessed nature of environment-contacting surface 27 with respect to the overall sphere-shape of ball 20 causes environment-contacting surface 27 to be rotated to a position within socket 40 in a non-contacting relation with internal surface 41 of socket 40, separated therefrom by annular space 37.

Such full rotation of ball 20 within socket 40 by moving tab 22 completely across first open end 43 of socket 40 results in closure 10 being rotated to its open position. As environment-contacting surface 27 is recessed with respect to the overall sphere defining the shape of ball 20, it does not contact inside surface 41 of socket 40 during such travel.

However, as ball 20 is rotated to the fully open position, perimetrical edge 27*a* of environment-contacting surface 27 which defines the transition between the overall sphere-shape of ball 20 and the recessed portion of environment-contacting surface 27 passes beyond protrusion 42*a* of dimple 42, providing for an interference engagement therebetween and resulting in an audible and tactile "click stop" feedback for the operator, thus providing an indication that ball 20 has been fully rotated within socket 40 to the open position.

This open position effects the alignment of first open end 23 of ball 20 with first open end 43 of socket 30 as well as alignment of second open end 24 of ball 20 with second open end 44 of socket 40, resulting in passageway 21 extending through ball 20 between the outside environment and upper chamber 115 of collection tube 100. This alignment establishes a path for insertion of a probe or for pouring of fluids contained within upper chamber 115, directly through passageway 21.

After effecting such use, closure 10 can be returned to its closed position by applying pressure to tab 22 in a direction opposite of that to open closure 10, i.e., in a direction toward passageway 21 of ball 22. Such pressure transmits a force to ball 20 about axle 30 in a similar manner as that exerted during opening of closure 10, thus causing ball 20 to rotate about axle 30 within socket 40 in an opposite direction as that used to open closure 10. This rotative movement causes liquid-contacting surface 29 to travel back across ball seat 45, to its original position where it is exposed to upper chamber 115 of collection tube 100. Upon such rotation, the cam-like engagement of opposed protrusions 31*a* and 31*b* of ball 20 and opposed cavities 51*a* and 51*b* of socket 40 forces the external surface of ball 20 at liquid-contacting surface 29 in a longitudinally downward direction, thus causing ball seat 45 to flex and ensuring a liquid-tight seal between ball 20 and socket 40 at ball seat 45.

Further, such rotational movement causes environment-contacting surface 27 to travel back across the perimeter of first open end 43 of socket 40 to its original position where it is exposed to the external environment. As environment-contacting surface 27 is recessed with respect to the overall sphere defining the shape of ball 20, it does not contact inside surface 41 of socket 40 during such travel. However, as environment-contacting surface 27 returns to its original position, perimetrical edge 27*a* of environment-contacting surface 27 which defines the transition between the overall sphere-shape of ball 20 and the recessed portion of environment-contacting surface 27 contacts dimple 42 as it passes thereover. Such contacting provides for interference engagement therebetween resulting in an audible and tactile "click stop" feedback for the operator, thus providing an indication that ball 20 has been fully rotated within socket 40 to the closed position.

Still further, once ball 20 is fully rotated within socket 40 to the closed position with environrment-contacting surface 27 of ball 20 being rotated past dimple 42, flat edge 53 of opposed cavities 51*a* and 51*b* in socket 40 frictionally engages opposed protrusions 31*a* and 31*b* of ball 20. Such engagement exerts a further longitudinal force on ball 20 in a longitudinal direction within socket 40, further forcing ball 20 onto ball seat 45. Such longitudinal force provides the operator with positive feedback that ball 20 has been fully rotated to the closed position by way of an additional audible and tactile "click stop" feedback, and further ensures that a liquid-tight seal is maintained between ball 20 and socket 40 at ball seat 45.

Ball 20 and socket 40 can be made of any known materials useful for such purposes. Preferably, both ball 20 and socket 40 are constructed of thermoplastic materials. More preferably, socket 40 is constructed from an elastomeric-like material, with ball 20 being constructed of a more rigid material. Most preferably, socket 40 is made of a material selected from polyethylene or thermoplastic elastomer (TPE), and ball 20 is made of a material selected from polystyrene or polypropylene. Such materials allow for ball 20 to be forcefully inserted into socket 40 past first open end 43 during assembly of closure 10.

Ball 20 and socket 40 can be manufactured using a variety of methods. Preferably, ball 20 and socket 40 are separately manufactured by molding procedures such as injection molding, and then assembled to form closure 10. Alternatively, ball 20 and socket 40 may be manufactured using a "dual-shot" or "two-shot" molding procedure, wherein ball 20 is fist molded and socket 40 is thereafter molded directly thereover. Various other molding and manufacturing methods are contemplated.

The closure of the present invention provides a number of improvements over prior art closures and techniques. In particular, the closure of the present invention minimizes splatter of liquid samples contained within a collection container. Additionally, there is no need to remove the closure to access the interior region of the collection container. The closure, however, may be removed from the collection container if desired. While the closure is capable of a firm attachment to the collection container, it is still capable of rotating independently of the container without the need for removal. The use of such an integrated closure permits ease of use for technicians with less risk of contamination in that there is a lower tendency to leave the collection container open since opening and closing of the container can easily be accomplished with a single hand.

Various other modifications to the foregoing disclosed embodiments will now be evident to those skilled in the art. Thus, the particularly described preferred embodiments are intended to be illustrative and not limited thereto. The true scope of the invention is set forth in the following claims.

What is claimed is:

1. A closure for sealing an open end of a specimen collection container from the environment comprising:

a socket mountable on said open end of said collection container for enclosing an interior region of said collection container, said socket including a ball receiving internal surface having a protrusion thereon; and a generally spherical-shaped ball mounted within said socket and at least partially enclosed thereby, said ball capable of rotative movement within said socket between an open position and a closed position, said ball including an external surface capable of interference engagement providing an audible and tachle feedback for with said protrusion of said socket upon rotative movement of said ball between said open position and said closed position.

2. A closure as in claim 1, wherein said protrusion includes a rib along said ball receiving internal surface.

3. A closure as in claim 1, wherein said protrusion includes a dimple on said ball receiving internal surface.

4. A closure as in claim 1, wherein said ball includes an environment-contacting surface exposed to an external environment when said ball is in said closed position, said environment-contacting surface being recessed with respect to said general spherical-shape of said ball to define a perimetrical edge therearound.

5. A closure as in claim 4, wherein said socket includes an open upper end permitting exposure of said environment-contacting surface to said external environment when said ball is in said closed position.

6. A closure as in claim 5, wherein said protrusion is located on said ball receiving internal surface of said socket at a position adjacent said open upper end of said socket.

7. A closure as in claim 6, wherein said perimetrical edge of said ball and said protrusion of said socket are capable of interference engagement therebetween.

8. A closure for sealing an open end of a specimen collection container from the environment comprising:

a socket mountable on said open end of said collection container for enclosing an interior region of said collection container, said socket including a ball receiving internal surface having a protrusion thereon; and a generally spherical-shaped ball mounted within said socket, said ball capable of rotative movement between an open position and a closed position, said ball including an environment-contacting surface, an opposed specimen-contacting surface and a passageway extending therethrough, said passageway being aligned with said open end of said collection container when said ball is in said open position, said environment-contacting surface being exposed to an external environment and said specimen-contacting surface being exposed to said interior region of said collection container when said ball is in said closed position, said environment-contacting surface of said ball being recessed with respect to said general spherical-shape of said ball to define a perimetrical edge, wherein said environment-contacting surface does not contact said interior surface of said socket when said ball is in said open position, and wherein rotative movement of said ball within said socket between an open position and a closed position causes interference engagement between said perimetrical edge of said environment-contacting surface and said protrusion of said internal surface of said socket.

* * * * *